US006851960B2

(12) United States Patent
Bain et al.

(10) Patent No.: US 6,851,960 B2
(45) Date of Patent: Feb. 8, 2005

(54) AC ADAPTER CONNECTOR ASSEMBLY

(75) Inventors: William O. Bain, Leander, TX (US); Christopher H. Muenzer, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/230,736

(22) Filed: Aug. 29, 2002

(65) Prior Publication Data

US 2004/0043651 A1 Mar. 4, 2004

(51) Int. Cl.[7] ..... H01R 29/00
(52) U.S. Cl. ..... 439/172
(58) Field of Search ..... 439/172, 680, 439/354, 677, 678, 732

(56) References Cited

U.S. PATENT DOCUMENTS

| | | | | | |
|---|---|---|---|---|---|
| 3,824,524 | A | * | 7/1974 | Glover | 439/60 R |
| 3,996,546 | A | * | 12/1976 | Hugly | 439/31 R |
| 4,013,330 | A | * | 3/1977 | Hugly | 439/31 R |
| D290,458 | S | * | 6/1987 | O'Leary | D13/28 |
| D317,290 | S | * | 6/1991 | Inaba et al. | D13/146 |
| 5,106,317 | A | | 4/1992 | Taylor | 439/173 |
| D333,293 | S | * | 2/1993 | Ashida | D13/133 |
| 5,243,510 | A | | 9/1993 | Cheney et al. | 363/146 |
| 5,494,449 | A | * | 2/1996 | Chioo | 439/761 |
| D372,460 | S | * | 8/1996 | Aramaki | D13/147 |
| 5,577,923 | A | * | 11/1996 | Lee | 439/170 |
| 5,830,001 | A | * | 11/1998 | Kinoshita et al. | 439/354 |
| 5,865,652 | A | * | 2/1999 | Stuter et al. | 439/680 |
| 6,179,633 | B1 | | 1/2001 | Inada | 439/131 |
| 6,217,390 | B1 | | 4/2001 | Casari | 439/651 |
| D453,921 | S | * | 2/2002 | Bussett et al. | D13/133 |
| 6,350,160 | B1 | * | 2/2002 | Feuersanger et al. | 439/680 |
| 6,516,418 | B1 | * | 2/2003 | Lee | 713/320 |
| 6,537,113 | B1 | * | 3/2003 | Chen | 439/888 |
| D475,014 | S | * | 5/2003 | Kano | D13/133 |
| 2001/0015579 | A1 | | 8/2001 | Nakagawa et al. | |

* cited by examiner

*Primary Examiner*—Ross Gushi
*Assistant Examiner*—Phuongchi Nguyen
(74) *Attorney, Agent, or Firm*—Baker Botts L.L.P.

(57) ABSTRACT

An AC adapter connector assembly is provided. The connector assembly includes both a connector plug and a socket. The connector plug includes a connector housing having a first body and a second body both extending from the connector housing. The second body is offset and in alignment with the first body. A first pin aperture and a third pin aperture are disposed within the first body while a second pin aperture is disposed within the second body. The socket assembly includes a socket housing having a first aperture and a second aperture offset from the first aperture. A first pin and a third pin are disposed within the first aperture and a second pin is disposed within the second aperture. The connector plug assembly is operable to couple with the socket assembly in a specific orientation and support both a three wire power cord and a two wire power cord.

21 Claims, 2 Drawing Sheets

AC ADAPTER CONNECTOR ASSEMBLY

TECHNICAL FIELD

This disclosure relates in general to the field of power transmission, and more particularly to an AC adapter connector assembly.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

The transmission of power to an information handling system is important especially with respect to portable devices such as laptop computers and personal digital assistants (PDA) that are designed to operate on both battery power and power supplied by a wall outlet. As portable devices have become more advanced and able to perform more functions, the portable devices require more power to operate. Because batteries only last for a finite time before requiring a new charge, many portable devices may also be able to plug into a wall outlet and operate on AC power. But since portable devices primarily operate on battery power (DC power), an AC adapter is required when powering a portable device from a wall outlet to convert the AC power to DC power. Generally, a portable device includes a power cord where one end of the power cord includes a wall plug that plugs into the wall outlet and the other end of the power cord includes a connector plug that plugs into a socket on the AC adapter where the socket and connector plug together are an AC adapter connector assembly for the transmission of power. A separate electrical cable runs from the AC adapter to the portable device to provide DC power to the portable device.

Current AC connector assemblies are designed to industry standards depending on whether the AC connector assembly supports two wire power cords or three wire power cords. Two wire power cords do not have a ground wire, have a wall plug with two prongs, and have a two contact AC connector assembly known as a "C7" connector. Three wire power cords do have a ground wire, typically have a wall plug with three prongs, and have a three contact AC connector assembly known as a "C5" connector. For safety reasons, AC adapters and AC connector assemblies are designed to operate only with either a two wire power cord or a three wire power cord and therefore have either a C5 connector assembly or a C7 connector assembly. For instance, an AC adapter having a C5 connector assembly cannot operate with a two wire power cord having a C7 connector plug and an AC adapter having a C7 connector assembly cannot operate with a three wire power cord having a C5 connector plug.

The incompatibility of the different standard AC connector assemblies creates problems when attempting to sell a common AC adapter world-wide because of different regional electrical standards. For example, the United States operates on 110 volts and has both two prong and three prong wall outlets. Europe operates on 220 volts and the higher voltage requires a ground wire and a ground prong so all wall outlets in Europe are three prong. Wall outlets in Japan typically have two prongs and therefore are not compatible with wall plugs having three prongs. In order for one AC adapter to satisfy all users world-wide, a three wire power cord, three prong wall outlet, and a C5 connector assembly must be used. But modifications must be made so that the AC adapter functions correctly and safely in the different regions and still satisfy all safety regulations such as those promulgated by the Underwriters Laboratory.

In the United States where three prong wall plugs are not required, having an AC adapter with a three wire power cord and three prong wall plug results in a bulkier than necessary wall plug and can create problems in older homes or businesses that have not been updated to have three prong wall outlets. In Japan, significant modification of the three wire power cord is required because Japan has only two prong wall outlets. The three wire power cord is modified to have a two prong wall plug where the ground wire terminates in a pigtail instead of terminating at the third prong on the wall plug. The user is supposed to fasten the pigtail underneath the screw attaching the outlet cover to the wall outlet to provide a ground. But most users never bother to attach the pigtail to the screw so that the attached device is not properly grounded which may cause electrical problems. In addition, the pigtail may accidentally hit the wall plug or wall outlet and cause a short in the AC adapter which creates an additional safety problem.

In addition, the C5 connector assembly is a bulky design that dictates the size of the AC adapter. An AC adapter must be large enough to accommodate the C5 connector assembly. The C5 connector has three contacts—line or hot, return or neutral, and ground. The hot and neutral contacts are side-by-side with the ground contact located above the hot and neutral contacts. This arrangement of the contacts requires that the AC adapter be a certain thickness in order to accommodate the C5 connector assembly. But AC adapters are often used with portable devices where smaller is better for portability reasons and the C5 connector assembly limits how small AC adapters can be designed because the AC adapter must be thick enough to accommodate the C5 connector assembly.

SUMMARY

Therefore, a need has arisen for an AC adapter connector assembly that is compatible with both a two wire power cord and a three wire power cord.

A further need has arisen for an AC adapter connector assembly that is common across different regions of the world.

A further need has arisen for an AC adapter connector assembly that allows for a thin profile design for AC adapters.

A further need has arise for an AC adapter connector assembly that is compatible with both a two wire power cord and a three wire power cord but that is not compatible with current industry standard connector assemblies.

In accordance with the teachings of the present disclosure, an information handling system and an AC adapter connector assembly including a connector plug assembly and a socket assembly are described which substantially eliminate or reduce disadvantages with previous AC adapter connector assemblies. The AC adapter connector assembly allows for a single AC adapter connector assembly that is compatible with both two wire power cords and three wire power cords that may be used world-wide and is incompatible with previous connector assembly designs while satisfying all safety regulations.

In accordance with one aspect of the present disclosure, a socket assembly is provided. The socket assembly preferably includes a socket housing having a first aperture and a second aperture. The second aperture is offset from the first aperture but adjacent and in alignment with the first aperture. Disposed within the first aperture is a first pin which is operable to receive and transmit an electrical signal. Offset but in alignment with the first pin is a second pin that is disposed within the second aperture. A third pin is disposed within the first aperture between the first pin and the second pin and in alignment with the first pin and the second pin. The socket assembly operably couples with a connector plug in a specific orientation.

In another aspect of the present disclosure, a connector plug assembly is provided. The connector plug assembly preferably includes a connector housing having a first body and a second body. The first body having a unique shape extending from the connector housing and includes a first pin aperture. The second body has a cylindrical shape extending from the connector housing, is offset from the first body, and includes a second pin aperture in alignment with the first pin aperture. A third pin aperture is disposed within the first body between and in alignment with the first pin aperture and the second pin aperture. The connector plug assembly is operable to couple with the socket assembly when the connector plug assembly is in a specific orientation.

In one embodiment, the connector plug assembly includes three contacts. A first contact disposed within the first aperture, a second contact disposed within the second aperture, and a third contact disposed within the third aperture. When the connector plug assembly mates with the socket assembly, the contacts operably couple with the pins of the socket assembly allowing for the transfer of an electrical signal from the connector plug assembly to the socket assembly. Within the connector housing, the contacts operably couple with the wires of a power cord. A two wire plug having a wall plug with two prongs couples with the contacts where one wire couples with the first contact and a second wire couples with the second contact. The third contact does not have any contact with the power cord and therefore no electrical signal is transmitted through the third contact to the third pin. With a three wire power cord having a wall plug with three prongs, the first and second wires couple with the contacts as described above while the third wire couples with the third contact allowing for an electrical signal to be transmitted through the three contacts to the three pins.

In another aspect of the present disclosure, an information handling system having a connector plug and a socket assembly is provided. The connector plug assembly transmits an electrical signal and includes a first body, a second body, and a plurality of pin apertures. The socket assembly includes a first aperture, a second aperture, and a plurality of pins disposed within the first and second apertures. The socket assembly is operable to mate with the connector plug assembly in a specific orientation. The information handling supports both a two wire power cord and a three wire power cord.

The present disclosure provides a number of important technical advantages. One important technical advantage is that the AC adapter connector assembly is compatible with both two wire power cords and three wire power cords allowing for commonization across different regions of the world. The design and layout of the contacts in the connector plug assembly allows for the connector plug to safely couple with either a two wire power cord or a three wire power cord. Because the wires of the power cord couple with the contacts of the connector plug assembly, it is not a difficult task to alter the AC connector assembly to function with either a two wire power cord or a three wire power cord. Therefore, the same AC adapter connector assembly can be used in Europe which requires three wire power cords having a three prong wall plug, in Japan which requires two wire power cords having a two prong wall plug, and in the United States which uses either two or three wire power cords. The ability to use the same AC adapter connector assembly and the same AC adapter world-wide reduces cost. In addition, the use of the AC adapter is safer because the same AC adapter can be tailored for each region of the world and still meet all safety requirements such as those promulgated by the Underwriters Laboratory.

Another important technical advantage of the present disclosure is that the arrangement of the contacts and pins for the AC adapter connector assembly allow for a thinner profile AC adapter. The layout of the contacts and pins in the AC adapter connector assembly are in a row instead of stacked like the C5 connector assembly. This allows for an AC adapter to have a thinner or lower profile than an AC adapter having a C5 connector assembly. Because the contacts and pins are arranged in a row instead of stacked, the AC adapter connector assembly requires less room vertically and therefore the AC adapter does not have to be as thick to accommodate the AC adapter connector assembly. Since the AC adapter can be made thinner, it can be made smaller in overall size which increases its portability which is an important aspect since the AC adapter may often be transported along with a portable device such as a laptop computer.

Another important technical advantage of the present disclosure is that the AC adapter connector assembly is not compatible with current industry connector assemblies such as C5 and C7 connector assemblies. The layout of the contacts and pins within the AC adapter connector assembly is such that a C5 or C7 connector plug will not mate with the socket of the present disclosure. Even though the contacts and pins are arranged in a row similar to the C7 connector assembly, the contacts and pins are spaced apart with the ground contact between the hot and neutral contacts so that a C7 connector plug will not fit in the socket. This incompatibility adds further safety to the AC adapter because it prevents a user from using a power cord having a C5 or C7 connector plug with the AC adapter where use of a wrong power cord may result in an electrical short, equipment damage, or a fire. In addition, the incompatibility prevents a user from using a power cord having a connector plug of the present disclosure with a device having either a C5 or C7 connector socket where such use may result in equipment damage or a fire. Furthermore, the incompatibility limits manufacturer product liability because a user cannot use a power cord specifically designed for the AC adapter on another electrical device.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to the figures, wherein like numbers are used to indicate like and corresponding parts.

Previous AC adapter connector assemblies have been designed to satisfy and support industry standards so that a three wire power cord may only be used with an AC adapter designed for three wire power cords and a two wire power cord can only be used with an AC adapter designed for two wire power cords. A single AC adapter has not been able to be safely used with both two wire and three wire power cords and still satisfy electrical safety regulations. Furthermore, existing three wire AC adapter connector assemblies have a bulky design and have prevented sleeker, smaller, and more portable designs for AC adapters. The present disclosure allows for an AC adapter connector assembly including a connector plug and a socket that is operable to support both two wire and three wire power cords where the layout of the connector assembly allows for a smaller and more portable AC adapter and is incompatible with industry standard connector assemblies.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
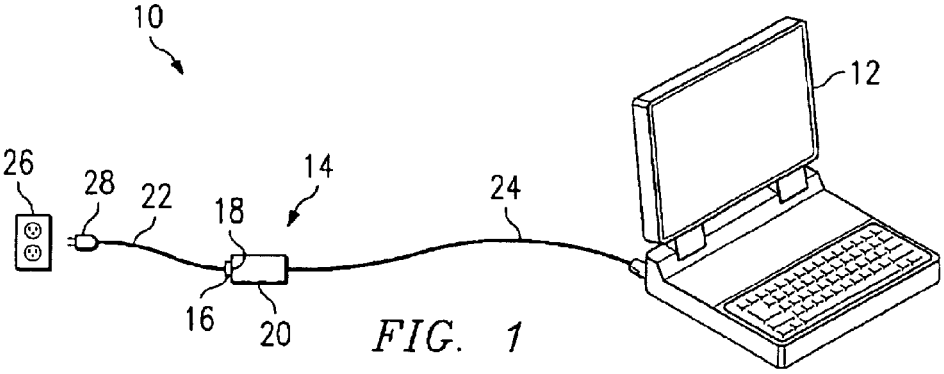
FIG. 1 is a schematic representation of an information handling system.

FIG. 1 is a schematic representation of information handling system 10 including computer 12 and AC adapter connector assembly 14. Connector assembly 14 includes connector plug 16 and socket 18 and may also be referred to as an information handling system. Information handling system 10 further includes AC adapter 20, power cord 22, and electrical cable 24.

In the embodiment shown in FIG. 1, computer 12 may be any type of portable device such as a laptop or PDA that operates on battery power (DC power) but can also be plugged into electrical or wall outlet 26 via AC adapter 20 to operate on power supplied by electrical outlet 26. Connector assembly 14 couples with electrical outlet 26 and computer 12 to provide power to computer 12 via wall plug 28 plugging into electrical outlet 26. This allows electrical current or power to flow from electrical outlet 26 through power cord 22 and connector assembly 14 to AC adapter 20. AC adapter 20 receives the AC power signal from electrical outlet 26 and converts it into a DC power signal that can be used by computer 12. The DC power signal travels from AC adapter 20 along electrical cable 24 to computer 12.

In the embodiment shown in FIG. 1, wall plug 28 is a two prong wall plug and power cord 22 is a two wire power cord. In alternate embodiments, wall plug 28 may be a three prong wall plug and power cord 22 may be a three wire power cord. A two wire power cord 22 generally includes a two prong wall plug 28 and a three wire power cord 22 typically includes a three prong wall plug 28. The third prong in a three prong wall plug and the third wire in a three wire power cord is a ground prong and a ground wire that allows for computer 12 to be grounded. The type of the device attached to AC adapter and the region of the world where information handling system 10 is located determines the number of wires in power cord 22 and the number of prongs on wall plug 28. For example, the 220 volt requirement in Europe requires all electrical devices to be grounded and therefore the power cords are three wire and the wall plugs are three prong. Japan only has two prong electrical outlets so that Japan requires two wire power cords and two prong wall plugs. Connector assembly 14 supports both three wire power cords and two wire power cords thereby allowing AC adapter 20 to be used world-wide without having to change any of the internal electronics of AC adapter 20.

Figure 2A:
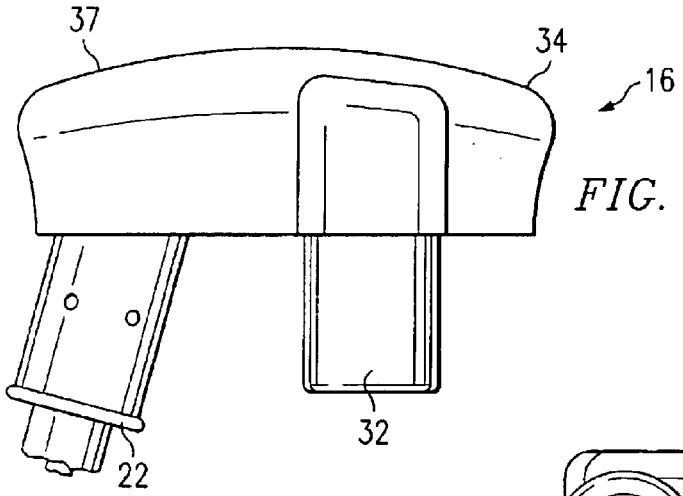
FIG. 2A depicts a side view of one embodiment of a connector plug assembly.
Figure 2C:
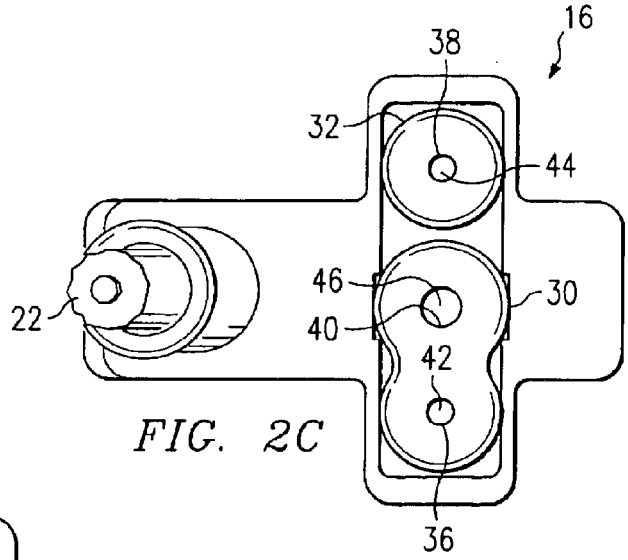
FIG. 2C depicts a bottom view of one embodiment of the connector plug assembly.
Figure 2B:
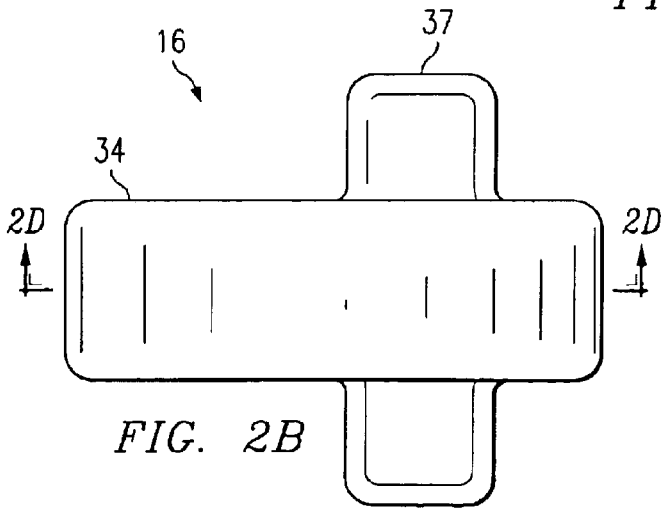
FIG. 2B illustrates a top view of one embodiment of the connector plug assembly.
Figure 2D:
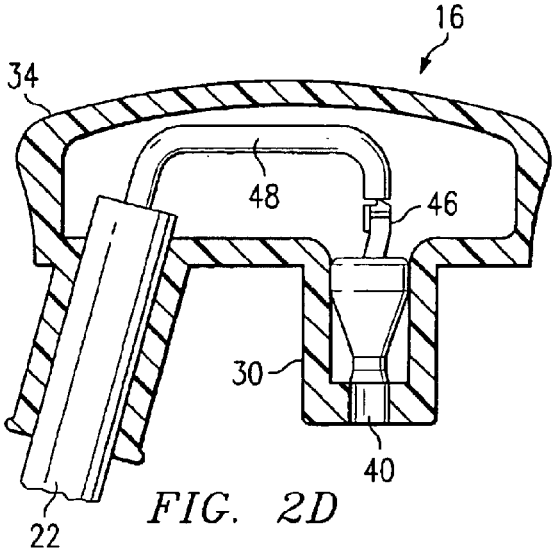
FIG. 2D illustrates a sectional view of one embodiment of the connector plug assembly.
Figure 2E:
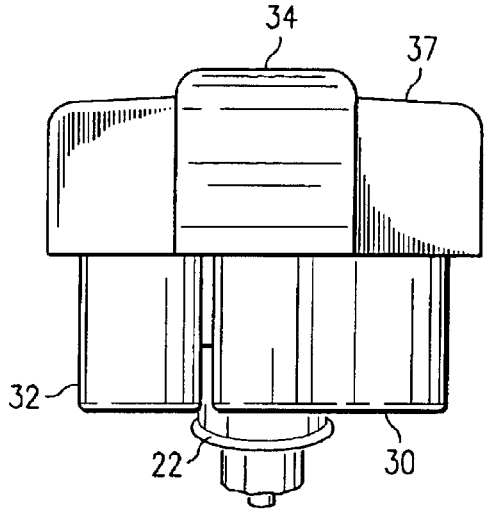
FIG. 2E depicts a front view of one embodiment of the connector plug assembly.

FIGS. 2A, 2B, 2C, 2D, and 2E represent different views of one embodiment of connector plug 16. FIG. 2A depicts a side view of connector plug 16, FIG. 2B illustrates a top view of connector plug 16, FIG. 2C depicts a bottom view of connector plug 16, FIG. 2D illustrates a sectional view of connector plug 16 taken along line X—X, and FIG. 2E illustrates a front view of connector plug 16.

Connector plug 16 is used as part of connector assembly 14 to provide DC power to computer 12 and couples with socket 18. Connector plug 16 includes first body 30, second body 32, and connector housing 34 all formed of an appropriate non-conductive material. First body 30 extends from connector housing 34 and has a unique shape. The unique shape of first body 30 is a shape that is not compatible with any other electrical connector assembly designs. In the embodiment shown in FIG. 2, the shape of first body 30 is similar to that of a figure eight but may be any other appropriate incompatible shape in alternate embodiments. Second body 32 extends from connector housing 34 and has a cylindrical shape. Second body 32 is offset from first body 30 but is in alignment with first body 30 with respect to connector housing 34. Both first body 30 and second body 32 extend from connector housing 34 at a ninety degree angle. In alternate embodiments, first body 30 and second body 32 may extend straight out with no angle from connector housing 34 or at any other appropriate angle of extension.

Disposed in first body 30 is first pin aperture 36. First pin aperture 36 extends through first body 30 the length of first body 30 and into connector housing 34. Disposed in second body 32 is second pin aperture 38. Second pin aperture 38 extends through second body 32 the length of second body 32 and into connector housing 34. Second pin aperture 38 is offset from first pin aperture 36 and is in alignment with first pin aperture 36 with respect to connector housing 34. Third pin aperture 40 is also disposed in first body 30 and as with first pin aperture 36, third pin aperture 40 extends through first body 30 the length of first body 30 into connector housing 34. Third pin aperture 40 is disposed between first pin aperture 36 and second pin aperture 38 so that first pin aperture 36, third pin aperture 40, and second pin aperture 38 are in linear alignment. First pin aperture 36 and second pin aperture 38 are the same size while third pin aperture 40 is of a larger size having a larger opening diameter.

Disposed within each pin aperture 36, 38, and 40 is a contact made of a conductive material that allows for the transmission of an electrical signal from connector plug 16 to socket 18 when power cord 22 is coupled to electrical outlet 26. First contact 42 is disposed within first pin aperture 36, second contact 44 is disposed within second pin aperture 38, and third contact 46 is disposed within third pin aperture 40.

Power cord 22 enters into connector housing 34 and couples with connector housing 34 and contacts 42, 44, and 46. As shown in the embodiment in FIG. 2, power cord 22 enters into connector housing 34 at approximately a ninety degree angle. In alternate embodiments, power cord 22 may enter into connector housing 34 along a straight-line path or any other appropriate angle of entry. Connector housing 34 further includes overmold 37 composed of a non-conductive material that couples power cord 22 to connector housing 34 and holds power cord 22 in place with respect to connector housing 34. Furthermore, overmold 37 protects connector plug 16 from damage and protects users from an electrical shock when inserting and removing connector plug 16 from socket 18. Overmold 37 allows for a place for a user to grab and grip connector plug 16 to facilitate the insertion and removal of connector plug 16 into and out of socket 18.

How power cord 22 couples with contacts 42, 44, and 46 depends on how many wires 48 there are in power cord 22. With respect to AC power, there can be either two or three electrical signals—line or hot, return or neutral, and ground. A two wire power cord includes a wire for hot and a wire for neutral while a three wire power cord has a wire for hot, a wire for neutral, and a wire for ground. Connector plug 16 has the ability to support both a two wire power cord and three wire power cord. When power cord 22 enters into connector housing 34, each individual wire 48 of power cord 22 separates out and couples to a specific contact 42, 44, or 46. The individual wires 48 may be soldered to contacts 42, 44, and 46 or coupled by any other appropriate means of coupling. For example, hot wire 48 couples to second contact 44 and neutral wire 48 couples to first contact 42 whether power cord 22 is a two wire power cord or a three wire power cord. Ground wire 48 couples to third contact 46 when power cord 22 is a three wire power cord.

The coupling of wires 48 to contacts 42, 44, and 46 allows for the transmission of an electrical signal from power cord 22 to contacts 42, 44, and 46. Which contact is hot and which contact is neutral may be alternated in alternate embodiments so long as third contact 46 couples to ground wire 48. Having the ground contact in-between the hot and neutral contacts adds a further safety feature in that the arrangement of contacts 42, 44, and 46 allows connector plug 16 to be different from and incompatible with any of the industry standard connector plugs such as C5 or C7.

The coupling of wires 48 to contacts 42, 44, and 46 allows for connector plug 16 and socket 18 to support both two wire power cords and three wire power cords. If power cord 22 is a two wire power cord, then power cord 22 only has a hot wire and neutral wire. The hot wire couples with second contact 44 and the neutral wire couples with first contact 42. There is no wire to couple with third contact 46. Therefore no electrical signal passes through third contact 46. But if power cord 22 is a three wire power cord, then the hot wire couples with second contact 44, the neutral wire couples with first contact 42, and ground wire 48 couples with third contact 46 and an electrical signal passes from power cord 22 to all three contacts 42, 44, and 46. Therefore, a three wire or a two wire power cord can be coupled to connector plug 16 based upon wires 48 coupling with contacts 42, 44, and 46. To provide greater safety features, third contact 46 may be omitted when power cord 22 is a two wire power cord.

Figure 3A:
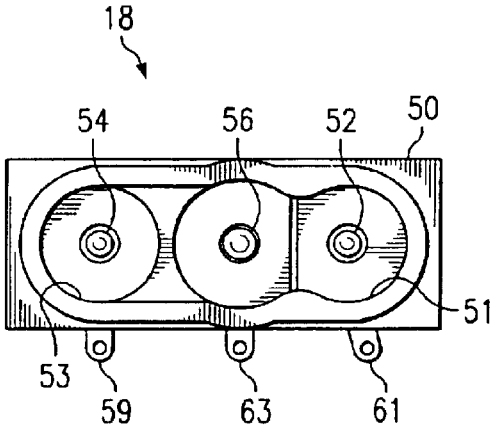
FIG. 3A depicts a front view of one embodiment of a socket assembly.
Figure 3C:
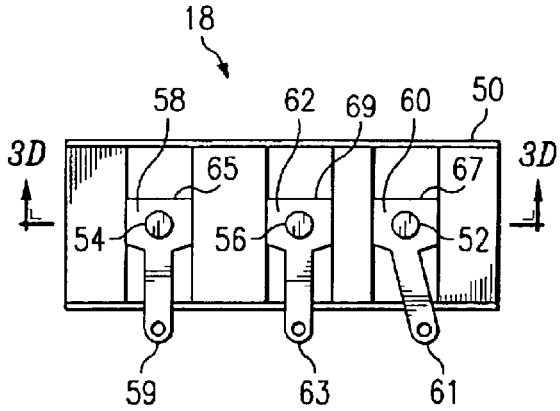
FIG. 3C depicts a section view of one embodiment of the socket assembly.
Figure 3B:
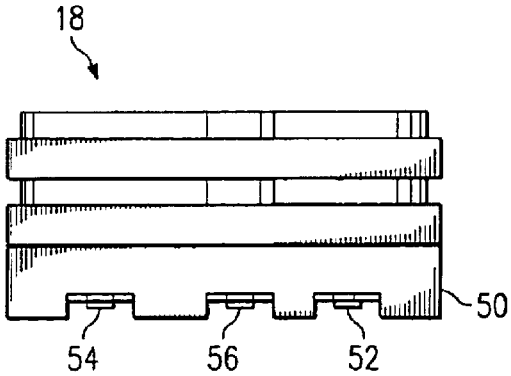
FIG. 3B illustrates a top view of one embodiment of the socket assembly.
Figure 3D:
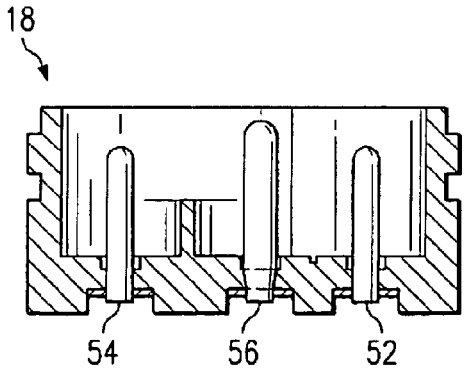
FIG. 3D illustrates a sectional view of one embodiment of the socket assembly.

FIGS. 3A, 3B, 3C, and 3D represent different views of one embodiment of socket 18 operable to couple with connector plug 16. FIG. 3A depicts a front view of socket 18, FIG. 3B illustrates a top view of socket 18, FIG. 3C depicts a sectional view of socket 18 taken along section line Y—Y, and FIG. 3D illustrates a sectional view of socket 18 taken along section line X—X.

Socket 18 is a receptacle for connector plug 16 and operably couples with connector plug 16 to provide an electrical signal from electrical outlet 26 to AC adapter 20 and onward to computer 12. Socket 18 includes socket housing 50 composed of a non-conductive material and two apertures—first aperture 51 and second aperture 53. First aperture 51 has a unique shape that correlates to the unique shape of first body 30 of connector plug 16 while second aperture 53 has a cylindrical shape that correlates with the cylindrical shape of second body 32 of connector plug 16. Second aperture 53 is offset from first aperture 51 but is adjacent to and in alignment with first aperture 51.

Socket 18 further includes three pins, first pin 52, second pin 54, and third pin 56, for receiving and transmitting electrical signals. Pins 52, 54, and 56 are composed of a conductive metal material. First pin 52 is disposed within first aperture 51. Second pin 54 is the same size as first pin 52 and is disposed within second aperture 53 and therefore offset from first pin 52. Second pin 54 is in alignment with first pin 52 so that first pin 52 and second pin 54 form a straight line. Third pin 56 is of a larger size than first pin 52 and second pin 54 and is disposed in first aperture 51 in-between first pin 52 and second pin 54. Third pin 56 is in alignment with first pin 52 and second pin 54 so that first pin 52, second pin 54, and third pin 56 form a straight line in the same horizontal plane. Third pin 56 is of a larger size to adequately provide a ground, for safety reasons to help prevent users from inserting standardized connector plugs into socket 18 that if connected could cause an electrical short of a fire, and to make socket 18 incompatible with industry standard connector plugs.

Disposed within socket 18 and AC adapter 20 at the backend of first aperture 51 and second aperture 53 are three socket contacts 58, 60, and 62. Socket contacts 58, 60, and 62 couple pins 52, 54, and 56 to AC adapter 20 and allow for the transmission of electrical signals from pins 52, 54, and 56 to AC adapter 20. Each socket contact is associated with a specific pin 52, 54, and 56 at top end 65, 67, and 69 of socket contacts 58, 60, and 62. For example, first pin 52 is pressed against top end 65 of first socket contact 58, second pin 54 is pressed against top end 67 of second socket contact 60, and third pin 56 is pressed against top end 69 of third socket contact 62. Socket contacts 58, 60, and 62 are soldered to a printed circuit board in AC adapter 20 at bottom ends 59, 61, and 63. Socket contacts 58, 60, and 62 allow for the transmission of electrical signals from contacts 42, 44, and 46 and pins 52, 54, and 56 to AC adapter 20 so that AC adapter may convert the AC signal to a DC signal in order to power computer 12.

When connector plug 16 couples or mates with socket 18, first body 30 couples with first aperture 51 and second body 32 couples with second aperture 53 so that first body 30 is disposed within first aperture 51 and second body 32 is disposed within second aperture 53. In addition, first pin 52 couples with first pin aperture 36, second pin 54 couples with second pin aperture 38, and third pin 56 couples with third pin aperture 40 so that first pin 52 is disposed within first pin aperture 36, second pin 54 is disposed within second pin aperture 38, and third pin 56 is disposed within third pin aperture 40. When pins 52, 54, and 56 are inserted into pin apertures 36, 38, and 40, first pin 52 comes into contact with first contact 42, second pin 54 comes into contact with second contact 44, and third pin 56 comes into contact with third contact 46 which allows for the transmission of an electrical signal from power cord 22 through contacts 42, 44, and 46 to pins 52, 54, and 56.

The unique shape of first aperture 51 and first body 30, second pin 54 being offset from first pin 52 and third pin 56, and third pin 56 being larger in size than first pin 52 and second pin 54 allows for connector plug 16 to only mate or couple with socket 18 in one specific orientation. If connector plug 16 is rotated or flipped over, connector plug 16 will not be able to mate with socket 18. Therefore the mating of connector plug 16 and socket 18 is keyed which contributes to connector assembly 14 being incompatible with industry standard connector assemblies which prevents a user from inserting an industry standard connector plug into socket 18 which provides additional safety features. The layout of pins 52, 54, and 56 as well as the unique shape of first aperture 51 and first body 30 creates a connector assembly shape that is not compatible with any other connector assemblies such as C5 or C7. This meets further safety requirements because a user will not be able to use power cord 22 with any other electrical device thereby potentially cause an electrical short or fire.

Socket 18 supports power cords 22 having both two wires and three wires. When connector plug 16 is mated with socket 18, pins 52, 54, and 56 are in contact with contacts 42, 44, and 46. With power cord 22 having two wires, the hot wire is coupled to second contact 44 with second pin 54 coupled to second contact 44 and the neutral wire is coupled to first contact 42 with first pin 52 coupled to first contact 42. This allows for the hot electrical signal to be transmitted from power cord 22 through second contact 44 to second pin 44 and to AC adapter 20 and the neutral electrical signal to be transmitted from power cord 22 through first contact 42 to first pin 52 and to AC adapter 20. Since there is no ground wire, no ground electrical signal is transmitted to third contact 46 and third pin 56 and therefore no ground is provided for AC adapter 20. Alternatively in the two wire configuration for further safety reasons, third contact 46 may be removed so that third pin 56 is not in contact with any conductive material and there is less worry of any stray electrical signal being transmitted via third pin 56 to AC adapter 20. With a three wire power cord 22, the hot and neutral wires are configured as described above and the ground wire is coupled to third contact 46 with third pin 56 coupled to third contact 46. This allows for a ground to be available to AC adapter 20 via ground wire 48 of power cord 22, third contact 46, and third pin 56.

In addition to supporting both two wire power cords and three wire power cords, connector assembly 14 provides double insulation protection as required by many safety regulations. Double insulation protection pertains to insuring that all distances between different electrical components, such as contacts 42, 44, and 46 and pins 52, 54, and 56, in an electrical device are of a safe distance both through the air and over the surface of the device. Double insulation protection provides insulation protection comprising both basic insulation (insulation applied to live electrical components to provide basic protection against electric shock) and supplementary insulation (independent insulation to provide protection against electric shock in the event of a failure of basic insulation). The spacing and layout of pins 52, 54, and 56, contacts 42, 44, and 46, and socket contacts 58, 60, and 62 are such to satisfy double insulation requirements and therefore provide a safer product to the user.

Although the disclosed embodiments have been described in detail, it should be understood that various changes, substitutions and alterations can be made to the embodiments without departing from their spirit and scope.

What is claimed is:

1. An AC adapter socket assembly comprising:

a socket housing for an AC adapter including a first aperture and a second aperture, the second aperture located adjacent to and in alignment with the first aperture;

a first pin disposed within the first aperture, the first pin operable to receive and transmit current from an associated AC power chord for connecting with a wall outlet;

a second pin disposed within the second aperture and offset from and in alignment with the first pin, the second pin operable to receive and transmit current from the associated AC power chord; and a third pin disposed within the first aperture and between the first pin and the second pin in alignment with the first pin and the second pin, the third pin operable to receive and transmit current from the associated AC power chord; and wherein the socket assembly is operable to couple with a connector plug assembly in a specific orientation and support a connection with both a three wire AC power chord and a two wire AC power chord.

2. The socket assembly of claim 1 wherein the second aperture has a cylindrical shape operable for mating with a second body of the connector plug assembly.

3. The socket assembly of claim 1 wherein the first aperture has a unique shape operable for mating with a first body of the connector plug assembly, the unique shape not compatible with standard electrical connector assembly designs.

4. The socket assembly of claim 1 further comprising:

a first socket contact disposed adjacent the first pin and operably coupling the first pin to the AC adapter;

a second socket contact disposed adjacent the second pin and operably coupling the first pin to the AC adapter; and a third socket contact disposed adjacent the third pin and operably coupling the third pin to the AC adapter.

5. The socket assembly of claim 1 wherein the second pin comprises a ground pin.

6. The socket assembly of claim 1 wherein the AC adapter is operable to support both a two wire AC power cord and a three wire AC power cord.

7. An AC adapter connector plug assembly comprising:

a connector housing associated with an AC power chord for connecting with a wall outlet;

a first body extending from the connector housing and including a first pin aperture;

a second body having a cylindrical shape and extending from the connector housing offset from the first body, the second body including a second pin aperture in alignment with the first pin aperture;

a third pin aperture disposed within the first body, the third pin aperture in alignment with and between the first pin aperture and the second pin aperture; and wherein the connector housing is operable to couple with an AC adapter socket assembly in a specific orientation and wherein the connector housing supports a connection to both a two wire AC power cord and a three wire AC power cord.

8. The connector plug assembly of claim 7 wherein the first body has a unique shape operable for mating with a first aperture of the socket assembly.

9. The connector plug assembly of claim 7 further comprising an overmold operably coupling the connector housing and the AC power cord.

10. The connector plug assembly of claim 7 further comprising:

a first contact disposed within the first aperture;

a second contact disposed within the second aperture; and a third contact disposed within the third aperture.

11. The connector plug assembly of claim 10 wherein the third contact comprises a ground contact.

12. The connector plug assembly of claim 10 further comprising AC power cord operably coupled to the first contact and the second contact, the power cord operable to transmit an electrical current.

13. The connector plug assembly of claim 12 wherein the power cord comprises a two wire power cord.

14. The connector plug assembly of claim 12 further comprising the power cord operably coupled to the third contact.

15. The connector plug assembly of claim 14 wherein the power cord comprises a three wire power cord.

16. An information handling system comprising:

an AC power cord connector plug assembly associated with an AC power cord for connecting with a wall outlet, the AC power cord connector plug assembly including a plurality of pin apertures, a first body having a unique shape, and a second body offset from the first body and having a cylindrical shape, the connector plug assembly operable to support a connection to both a three wire AC power cord and a two wire AC power cord; and an AC Adapter socket assembly including a plurality of pins, a first aperture, and a second aperture, the second aperture located adjacent to and in alignment with the first aperture, the socket assembly operable to mate with the connector plug assembly in a specific orientation and support connection with both a two wire AC power chord and a three wire AC power chord.

17. The information handling system of claim 16 wherein the pins comprise:

a first pin disposed within the first aperture, the first pin operable to receive and transmit an electrical signal associated with the power chord;

a second pin disposed within the second aperture and offset from and in alignment with the first pin, the second pin operable to receive and transmit an electrical signal; and a third pin disposed within the first aperture and between the first pin and the second pin in alignment with the first pin and the second pin, the third pin operable to receive and transmit an electrical signal.

18. The information handling system of claim 16 wherein:

the first body is operable to couple with the first aperture; and the second body is operable to couple with the second aperture.

19. The information handling system of claim 16 wherein the pin apertures comprise:

a first pin aperture disposed within the first body;

a second pin aperture disposed within the second body, the second pin aperture offset from the first pin aperture and in alignment with the first pin aperture; and a third pin aperture disposed within the first body, the third pin aperture disposed between the first pin aperture and the second pin aperture and in alignment with the first pin aperture and the second pin aperture.

20. The information handling system of claim 16 wherein the power cord comprises a two wire power cord having a two prong wall plug.

21. The information handling system of claim 16 wherein the power cord comprises a three wire power cord having a three prong wall plug.

* * * * *